United States Patent [19]

Schmerl

[11] 4,121,605

[45] Oct. 24, 1978

[54] WALKING CANE ASSEMBLY

[76] Inventor: Egon F. Schmerl, 333 Scenic Ave., Piedmont, Calif. 94611

[21] Appl. No.: 823,964

[22] Filed: Aug. 12, 1977

[51] Int. Cl.[2] ..... A45B 1/00

[52] U.S. Cl. ..... 135/65; 135/66; 403/93; 403/95

[58] Field of Search ..... 135/65, 66, 72, 15 PQ, 135/76; 403/92, 93, 95, 96; 108/6

[56] References Cited

U.S. PATENT DOCUMENTS

| | | | |
|---|---|---|---|
| 731,437 | 6/1903 | Gzermak et al. | 135/66 X |
| 766,605 | 8/1904 | Dilg | 403/96 X |
| 3,179,436 | 4/1965 | Choy | 135/66 X |
| 3,289,685 | 12/1966 | Parker | 135/65 |
| 3,948,535 | 4/1976 | Negi | 403/93 X |
| 3,999,565 | 12/1976 | Delacour et al. | 135/65 |

FOREIGN PATENT DOCUMENTS

| | | | |
|---|---|---|---|
| 237,309 | 3/1959 | Australia | 135/15 PQ |
| 240,329 | 6/1946 | Switzerland | 135/76 |

*Primary Examiner*—Price C. Faw, Jr.
*Assistant Examiner*—Conrad L. Bevman

[57] ABSTRACT

A walking cane assembly involving a cane having a cane stabilizing arm extendable laterally from the cane at a location on said cane approaching the cane handle and terminating in a free end within convenient reach of the hand other than the one holding the cane when in use.

The cane handle is capable of adjustment for use by a right handed or left handed individual.

8 Claims, 13 Drawing Figures

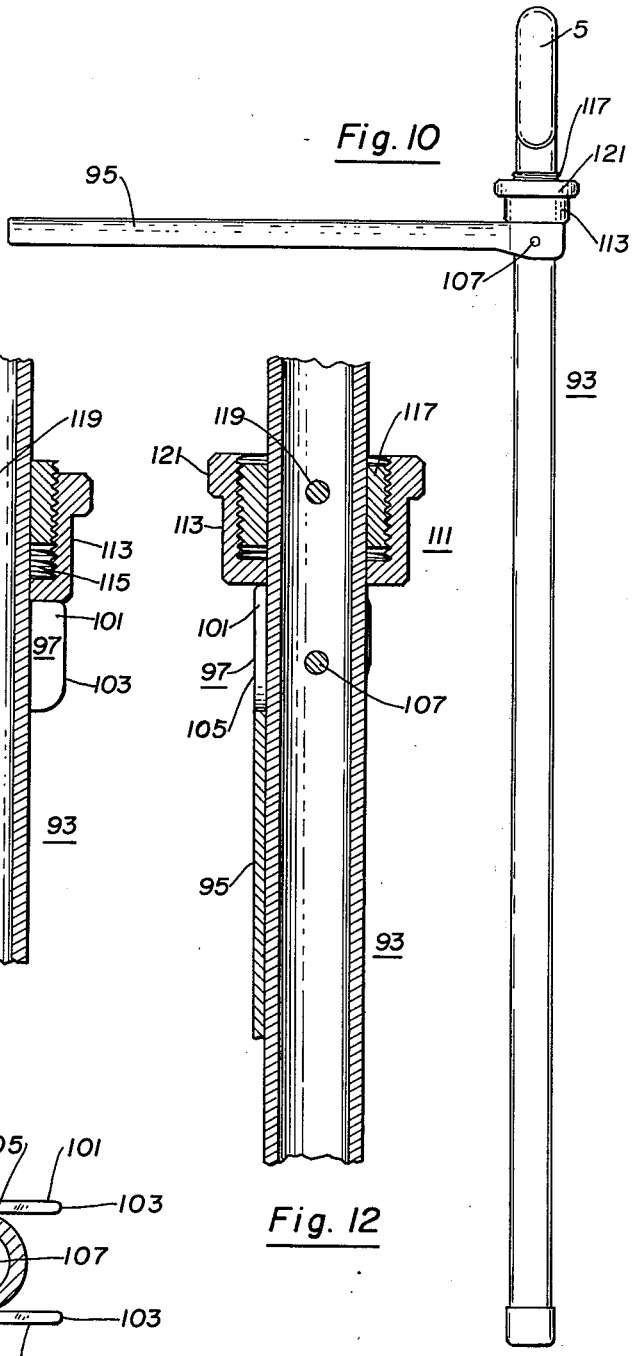
Fig. 10
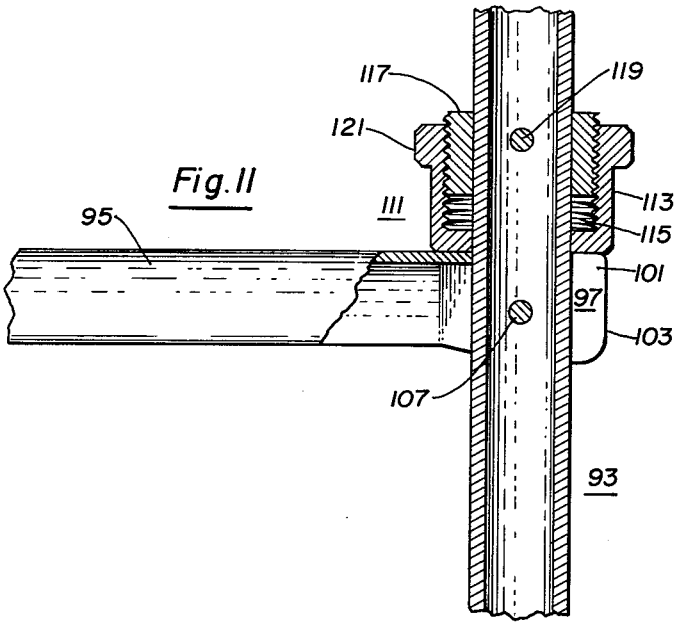
Fig. 11
Fig. 12
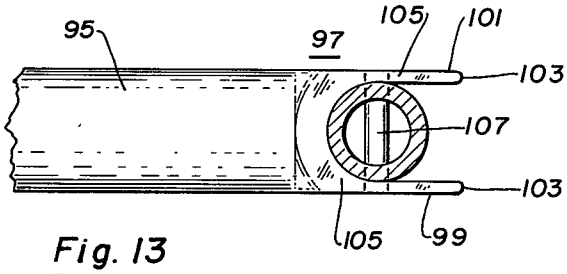
Fig. 13

WALKING CANE ASSEMBLY

My invention relates to devices for assisting an individual in walking, and more particularly to walking canes.

Many individuals, for one reason or another, are quite unstable on their feet and due to such instability, find it difficult to walk, even with the aid of a cane, as the cane will wobble under the circumstances and not offer the support it is intended to render the individual.

One attempt at remedying this situation is to provide the cane with a broad ground engaging base, as by attaching it to a frame work providing four spaced apart legs. The drawback to this approach as a solution to the problem, lies in the fact that the stability for which it is relied on, occurs primarily when the four legs are in ground engagement at the same time. This can occur only with the cane in a vertical position, and it will be appreciated that for one using such a cane, to maintain it in a vertical position at all times while walking, presents, in itself, a real problem.

Among the objects of my invention are:

(1) To provide a novel and improved cane assembly;

(2) To provide a novel and improved cane assembly for enabling stabilizing the cane when in use;

(3) To provide a novel and improved cane assembly for enabling stabilizing the cane when in use, without impairing use of such cane in a normal manner if desired;

(4) To provide a novel and improved cane assembly for enabling stabilizing of the cane when in use and with a minimum of effort on the part of the user;

(5) To provide a novel and improved cane assembly for enabling stabilizing the cane when in use and which can be converted to a conventional type cane for storage or when stabilization is not required;

(6) To provide a novel and improved cane assembly for enabling stabilizing the cane when in use, which cane assembly is simple in design and which may be economically produced.

Additional objects of my invention will be brought out in the following description of the same, taken in conjunction with the accompanying drawings, wherein FIG. 1 is a view in elevation of the cane assembly embodying the present invention when adjusted for use;

FIG. 10 is a view in elevation of another embodiment of the invention while FIGS. 11, 12 and 13 are fragmentary views, partly in section, depicting the internal features of the embodiment of FIG. 10.

Figure 1:
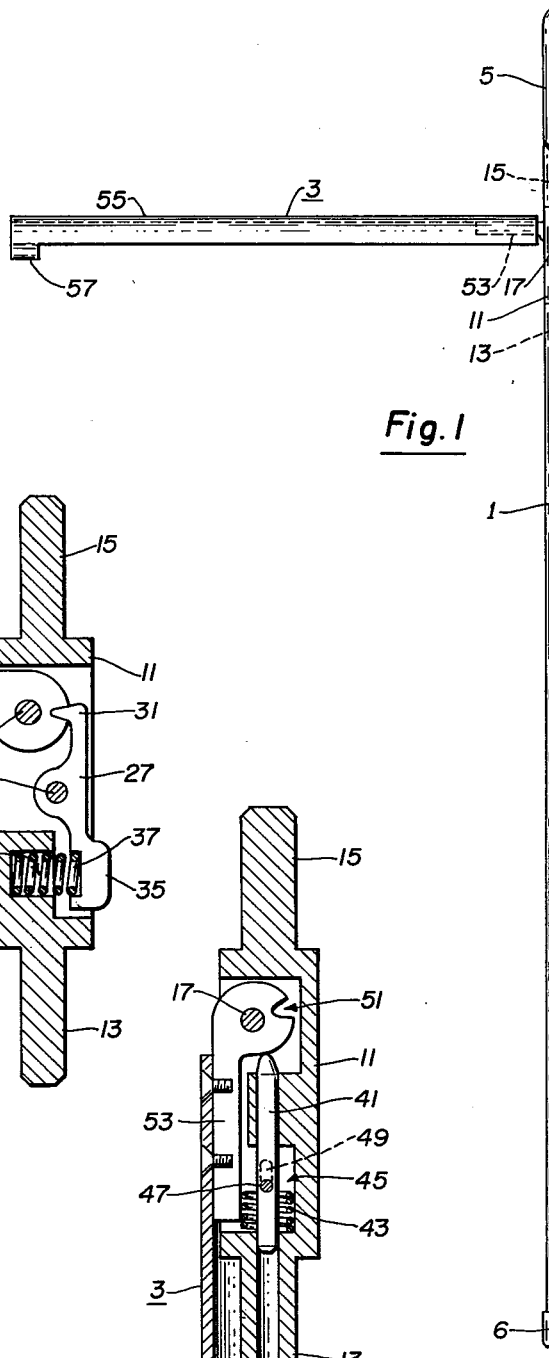
Figure 2:
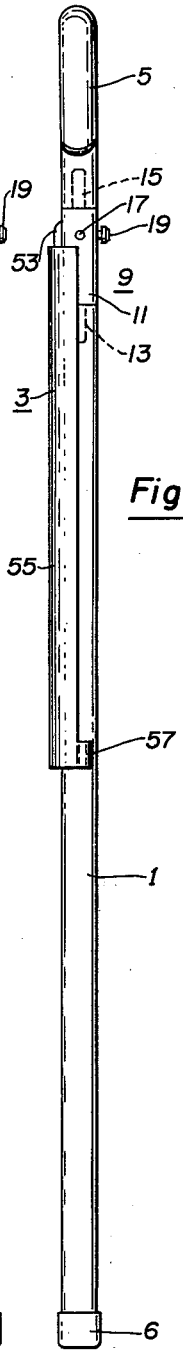
FIG. 2 is a view corresponding to that of FIG. 1, depicting the cane assembly of the present invention when adjusted for storage or for use as a conventional walking cane.

Basically, the invention involves a cane assembly including a cane 1 of a conventional type, provided with a cane stabilizing lever arm 3 extending laterally from the cane at a location approaching the handle end 5 of the cane, with the stabilizing lever arm terminating in a free end within convenient reach of the hand of the user, other than the hand holding the cane.

With the cane held in one hand and the end of the stabilizing lever arm in the other hand, the user then is in position to assist in minimizing or damping any oscillations of the cane due to instability of the user. For such purpose, only a minimal pressure on the lever arm is contemplated or deemed necessary.

This can be appreciated when one visualizes what happens to the stabilizing lever arm when the cane wobbles. Such wobbling occurs, about the ground engaging end of the cane, acting as a pivot, and results in tilting movements of the stabilizing lever arm. The user merely applies opposing forces sufficient to resist such tilting, and due to the leverage provided by the lever arm, such opposing forces need only be minimal. Thus in minimizing wobbling of the cane, the user stabilizes his own movements.

For therapeutic purposes, as when a patient is under the supervision of an attendant, the stabilizing lever arm may be threaded into either the left or right side of the cane, depending on whether the individual is right or left handed and the attendant can grasp the stabilizing arm to assist the patient, while the patient is undergoing therapeutic treatment.

The cane is preferably designed so that it might be used by those who get along with an ordinary cane but who at times may need more stabilizing support. These individuals are the ones whose equilibrium in standing is compromised because of deep sensory loss. Furthermore, people whose endurance is limited because of congestive heart failure, obstructive pulmonary disease, systemic myopathy or arthritis would at times resort to the steadiness of the guide-arm.

It will also be welcome for patients with paroxysmal problems such as angina or intermittent claudication. The steadying factor of the guide-arm is similar to the effect reported by patients who have used supermarket shopping carts for better endurance and balance. The ever-ready guide-arm is reassuring to those individuals who would generally feel at ease with an ordinary cane on short walks, but who would avoid long distance ambulation due to fear of getting into situations where more secure support might be wanted.

Further, as when climbing into a bus, one who was utilizing a cane with the stabilizing arm extended, might like to remove the arm from its extended position and hang the cane over his arm, so that the cane will be out of the way, leaving both hands free.

Toward this end, a latch housing 11 is installed in the cane at a location approaching the handle thereof, the stabilizing lever arm being mounted at its inboard end within the housing for movement between its laterally extending position and a position adjacent and alongside the cane.

The latch housing preferably has a cross sectional contour corresponding to that of the cane, and at each end is provided with a stem 13, 15 for insertion into a corresponding axial recess provided in the proximate portion of the cane in which it is to be installed. The housing may be glued or otherwise fastened in its installed position in the cane.

Figure 4:
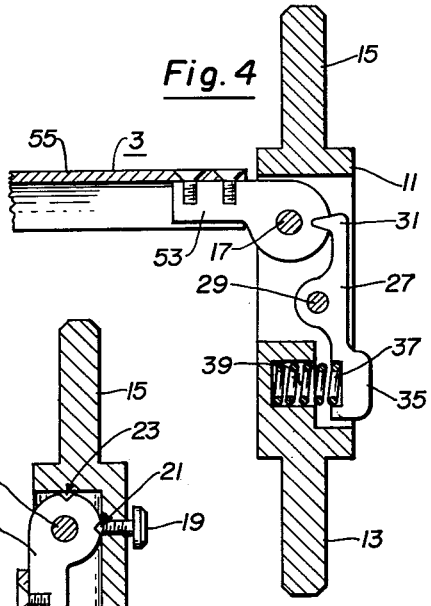
FIG. 4 is a view in section of a somewhat different mechanism corresponding to that of FIG. 3, and employable in the cane assembly of the present invention.
Figure 3:
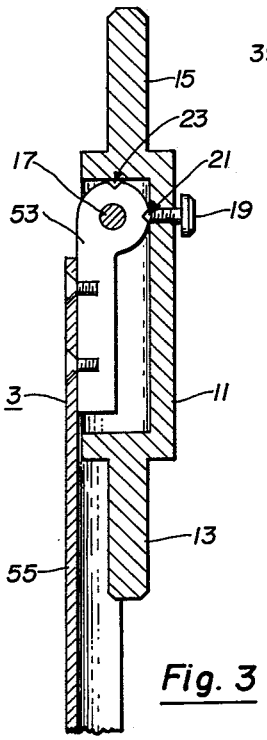
FIG. 3 is a view in section through one form of mechanism employable in the cane assembly of the present invention.
Figure 5:
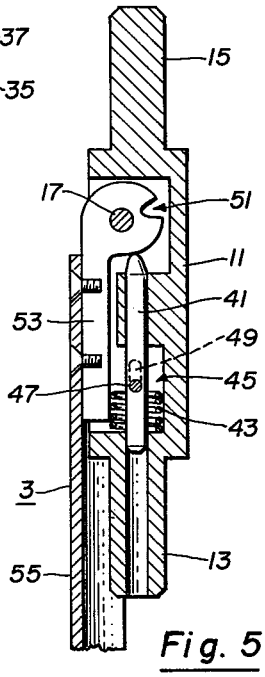
FIG. 5 is a view in section through a third form of mechanism employable in the cane assembly of the present invention.
Figure 6:
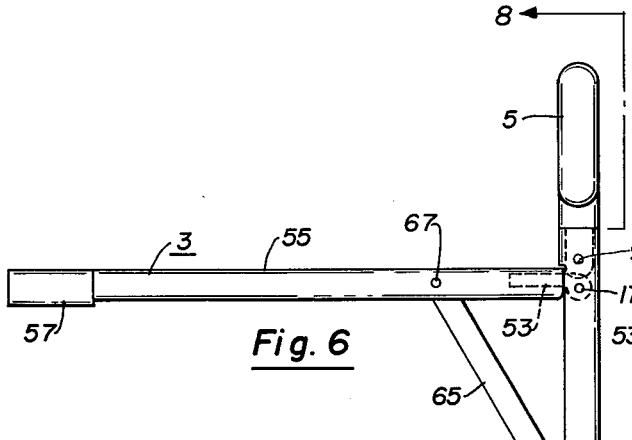
FIG. 6 is a view in elevation of a cane assembly employing another form of mechanism for meeting requirements of the present invention, with added features.

In each of the embodiments depicted in FIGS. 3, 4 and 5, the stabilizing lever arm is hingedly mounted on a cross pin 17 supported between opposing wall sections of the housing. In other respects, the various embodiments depicted in these figures differ only in the manner of latching the stabilizing lever arm in its laterally extending or functional position.

In the embodiment depicted in FIG. 3, the latching means involves a manually adjustable set screw 19 threaded through a wall of the housing in line with the anchored end of the stabilizing lever arm, which in its recessed end, is provided with two spaced recesses 21, 23 selectively engageable by the set screw which functions as a detent. Such recesses are so located that the set screw will engage one when the stabilizing lever arm is in its storage position, and will engage the other when the stabilizing lever arm is in its functioning position. At the option of the user, the stabilizing lever arm may thus be adjusted to either of such positions and retained in its selected position.

In FIG. 4, the latch mechanism is in the form of a push button lock involving a latching lever 27 rotatably mounted at an intermediate point thereof on a cross pin 29 located just below the anchored end of the stabilizing lever arm. This latching lever terminates at its upper end in a latch tip or detent 31 adapted to mesh with a complementary recess in the anchored end of the stabilizing lever arm when such stabilizing lever arm is in its functional position. At its lower end, the latching lever terminates in a push button 35 which is biased outwardly by a spring 37 interposed between the push button and the floor of a recess 39 within the housing. Such spring functions to maintain the latching end of the lever in constant engagement with the anchored end of the stabilizing lever arm, whereby, as such arm is raised from its position against the cane to its functional position, the latching end of the latching lever will enter the recess and retain the stabilizing lever arm in its functional postion. Pressure applied to the push button will serve to withdraw the detent and permit the stabilizing lever arm to be lowered to its storage position against the cane.

In the embodiment depicted in FIG. 5, the latching mechanism is in the form of a spring lock assembly involving an axially installed latch pin or detent 41 biased upwardly against the anchored end of the stabilizing lever arm by a biasing spring 43 installed in a recess 45 within the housing and bearing against a cross pin 47 which passes transversely through the housing with its ends slidably resting in elongated openings 49 in opposing walls of the housing and extending sufficiently beyond each wall to permit manual engagement. A recess or notch 51 is provided in the anchored end of the stabilizing lever arm at a location which will bring it into alignment with the latch pin 41 when the stabilizing lever arm is elevated to its functioning position. Release of the stabilizing lever arm may be affected by applying pressure to the pin 47 sufficient to depress and force withdrawal of the latch pin from the recess 51 and permit the lever arm to be lowered to its storage position.

In the various embodiments illustrated and described above, the stabilizing lever arm 3 is preferably fabricated of two components, namely a bracket arm 53 at the hinged end and a flexible hand-grip extension 55 riveted or otherwise affixed to the bracket arm. At the free end of the hand grip extension, an appropriate hand-grip (not illustrated) may be installed.

Preferably, the bracket arm is sufficently short to be received into the housing when the stabilizing lever arm is lowered from its functional position, thus bringing the hand-grip extension alongside the cane, substantially into contact therewith. By forming the hand-grip section to be approximately semi-cylindrical in cross-section to fit the cane, the hand grip extension will mesh with the cane in the lowered position of the stabilized lever arm, and by adding arcuate holding tabs 57 at the extreme end of the hand grip extension, such tabs will function as a clip to resiliently grip the cane and releasably retain the stabilizing lever arm in its storage position.

The embodiment of FIGS. 6, 7, 8 and 9, while applicable to solid canes in the manner of the preceding embodiments, is better adapted to canes formed of tubular material such as aluminum tubing 59 which has a longitudinal slot 61 just below the handle and provides the housing for the stabilizing lever arm anchoring pin 17 and the lever supporting means 63.

Such supporting means comprises a bracket 65, at one end 67 being hingedly secured to the stabilizng lever arm, with its other end 69 passing through the slot where it is hingedly secured by a pin 71 to a piston 73 slidably installed within the tubing of the cane. The lower end of the piston is recessed. At diametrically opposite points in the cylindrical wall 75 thus formed the wall is provided with holes to receive lateral extensions 77 formed adjacent the ends of the legs of a V-shaped spring 81.

Raising and lowering of the lever arm 3 will cause the piston to slide accordingly, and with the lever arm in its functional position, the cane is provided with diametrical holes 73 in alignment with the lateral extensions 77 of the spring 81 whereby such extensions may enter such holes and lock the lever arm in its functional position.

Figure 7:
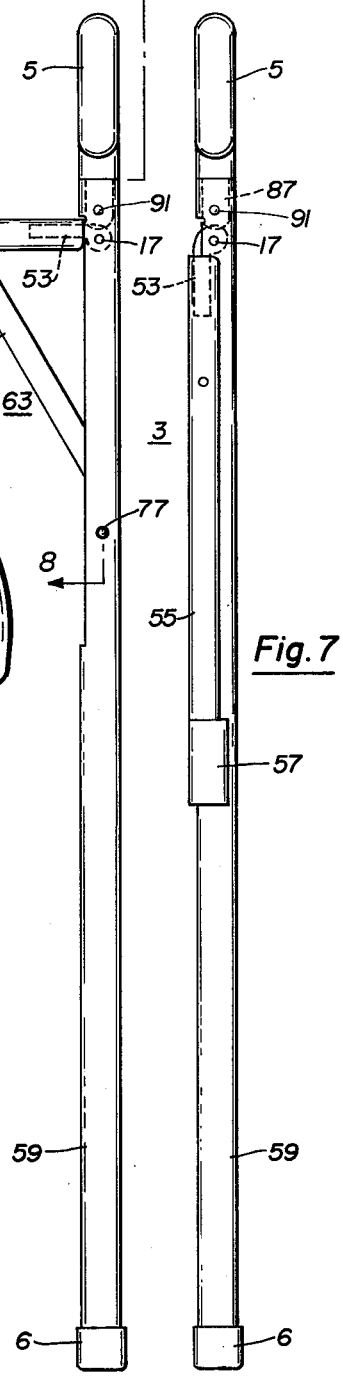
FIG. 7 is a view of the cane of FIG. 6 adjusted for storage or use as a convention cane.
Figure 8:
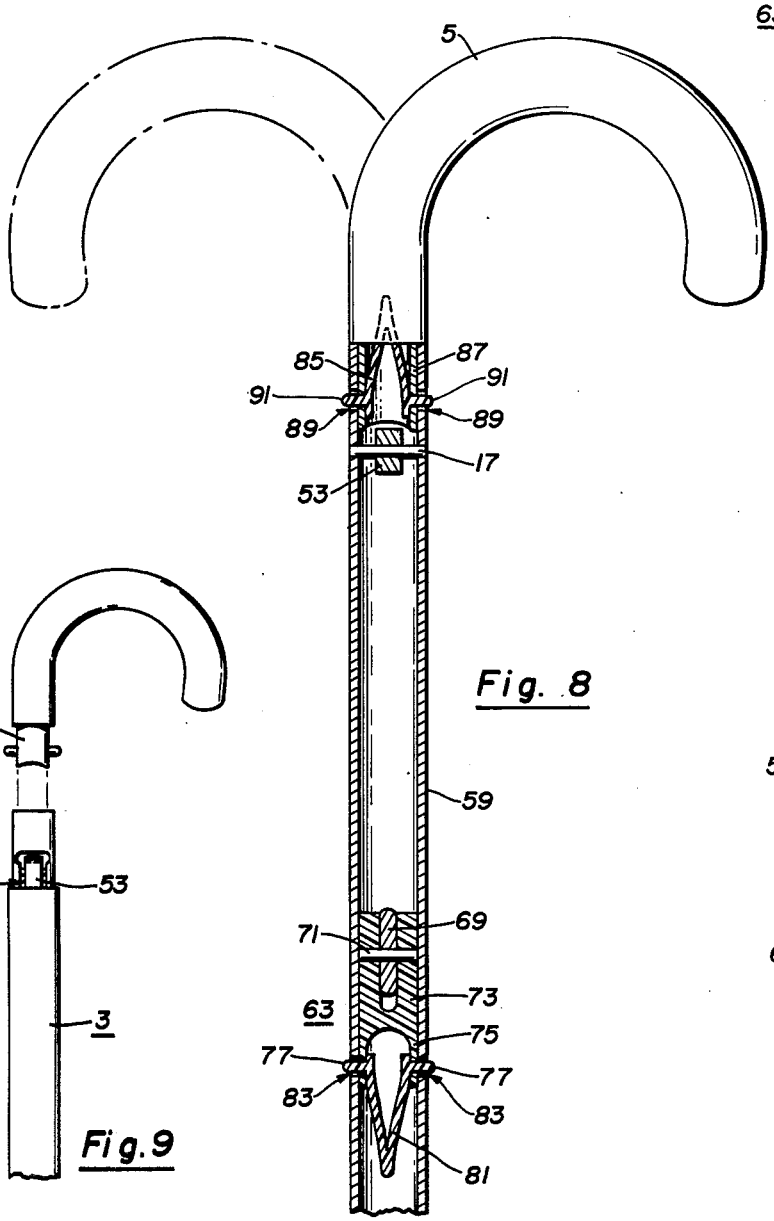
FIG. 8 is a view partly in section and FIG. 9 is a partially exploded view depicting internal structural details of the mechanism employed in the cane assembly of FIGS. 6 and 7.
Figure 9:
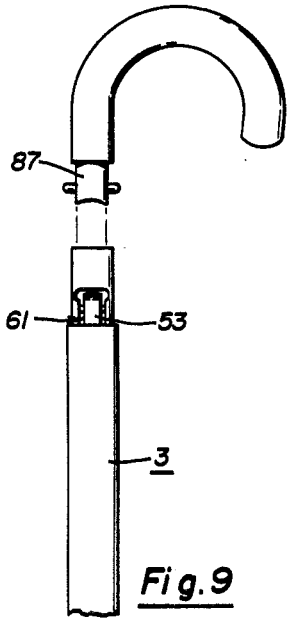

These lateral extensions should preferably extend somewhat beyond the cane wall and should be rounded off at their extremeties to provide cam surfaces, whereby, upon pressing them inwardly, and simultaneously bearing down on the lever arm, the spring will be released from its locking relationship with the cane and the lever arm can then be lowered to its storage position against the cane as depicted in FIG. 7.

In assembling the lever supporting means 63, the bracket 65 is first connected to the piston 73, and with the spring 81 in place, the assembly is inserted, bracket first through the lower end of the cane and driven forward to expose the bracket through the slot, following which it may be withdrawn through the slot and secured to the lever arm 3.

A V-shaped spring 85 similar to the spring 81, may be utilized in connection with a handle 5 to enable reversal of position of the handle for use by a right or left handed individual, as the case may be.

With this in mind, the handle which preferably matches the tubing 59 in diameter, is provided with an extension 87 to telescopically fit into the upper end of the tubing, such fit enabling rotational movement of the handle in the tubing.

Through the extension and tubing are provided diametrically located aligned holes 89 to receive the lateral extensions 91 of the spring 85 to lock the handle in either of two diametrically opposite positions.

If it is desired to switch the position of the handle, say from a right hand position to a left hand position, the lateral extensions are depressed with the fingers of one hand, while exerting a turning or rotating force on the handle with the other hand. As the cam surfaces on the lateral extensions reach the inner wall of the tubing, the turning force on the handle will drive the lateral extensions inwardly sufficiently to permit turning of the handle until the lateral extensions are permitted to again enter the holes and lock the handle in its desired position.

The embodiment of FIGS. 10–13 may readily be incorporated into either a solid or hollow cane, though illustrated as incorporated into a hollow cane 93; which may be of aluminum, where light weight is desired.

The stabilizing arm 95 of this embodiment is, like the previously described arms, substantially semi-cylindrical in section, and terminates at its inboard end in a yoke 97 involving a par of parallel arms 99, 101, and adapted to straddle the cane with the arms preferably extending slightly beyond the cane and terminating in parallel straight edges 103 in a common plane normal to the longitudinal axis of the stabilizing arm. Similarly, the upper edges 105 of the yoke arms lie in a common plane at substantially right angles to the end edges.

The stabilizing arm is hingedly affixed to the cane by a pin 107 which is preferably removable to permit reversal of the arm to meet the requirements of a left or right handed individual. With the stabilizing arm so installed, it can be retained in a positive manner in either its horizontal usable position or its lowered stored position, by an adjustable lock assembly 111 of very simple construction, installed on the cane just above the yoke of the stabilizing arm.

Such lock assembly involves a cup shaped lock nut 113 having internal threads 115 in threaded engagement with an externally threaded ring 117 installed about the cane and fixed thereon by a cross pin 119. The cup shaped lock nut is disposed with its bottom facing the yoke, and is adapted to be adjusted into engagement with the yoke in either position of the arm, merely by adjustment of the nut on the threaded ring.

To facilitate the making of such adjustments, the nut is preferably formed with a knurled flange 121 at its upper rim.

From the foregoing description of my invention in its preferred forms, it will be appreciated that the same is subject to alteration and modification without departing from the underlying principles involved, and I, accordingly, do not desire to be limited in my protection to the specific details illustrated and described except as may be necessitated by the appended claims.

I claim

1. A cane assembly comprising a cane having at one extremity, a ground engaging end and at its opposite extremity, a manually engageable end for grasping with one's hand; a cane stabilizing lever arm; means attaching said stabilizing lever arm at said manually engageable cane end at a location thereon abutting said hand grasping end, with said stabilizing lever arm extending laterally from said cane in functional position, said stabilizing lever arm terminating in a free end within convenient reach of one's other hand when said cane is in use.

2. A cane assembly in accordance with claim 1, characterized by said means for attaching said stabilizing lever arm to said cane, including means hingedly securing said arm to said cane to enable dropping of said arm from such laterally extending or functional position to a position adjacent and alongside said cane, and means for releasably retaining said arm in such functional position.

3. A cane assembly in accordance with claim 2, characterized by said means for releasably retaining said stabilizing lever am in its functional position including a hinge connection of said stabilizing lever at one end to said cane and latch means in said cane adapted to latch with the hinged end of said stabilizing lever arm when said stabilizing lever arm is raised to its functional position.

4. A cane assembly in accordance with claim 2, characterized by said means for hingedly securing said stabilizing lever arm to said cane including a housing installed in said cane and constituting a part thereof, a hinge pin passing through the inboard end of said stabilizing lever arm and installed at its ends in opposing wall sections of said housing, and further characterized by said means for releasably retaining said stabilizing lever arm in its functional position including a detent in said housing and a recess in the hingedly secured end of said stabilizing lever arm adapted to come into alignment with said detent when said stabilizing lever arm reaches its functional position, and means for urging said detent into said recess when such alignment occurs.

5. A cane assembly in accordance with claim 1, characterized by said cane being hollow adjacent said manually engageable end, and said manually engageable end including a handle telescopically assembled to the proximate portion of said cane to permit rotation of said handle from a right hand position to a left hand position or vice-versa, and means for releasably locking said handle in either of said positions.

6. A cane assembly in accordance with claim 5, characterized by said releasable locking means including the telescopically assembled portions of said cane having diametrically located holes therethrough and a V-shape spring in said cane having lateral extensions in said holes.

7. A cane assembly in accordance with claim 2, characterized by said arm, at its hinged end, terminating in an end edge substantially normal to the longitudinal axis of said arm and an upper edge at substantially a right angle to said end edge, and further characterized by said releasable retaining means for said arm including an adjustable lock assembly adapted to lock said arm in either its functional position or its position adjacent and alongside said cane.

8. A cane assembly in accordance with claim 7, characterized by said adjustable lock assembly including an externally threaded ring fixed about said cane above the hinged end of said stabilizing lever arm, and a cup shaped nut between said threaded ring and the hinged end of said lever arm, said cup-shaped nut having internal threads in threaded engagement with said threaded ring, to enable selective adjustment of said nut into and away from engagement with either of said stabilizing lever arm edges to lock said arm in either of its desired positions.

* * * * *